US006824129B2

(12) United States Patent
Sides, II

(10) Patent No.: US 6,824,129 B2
(45) Date of Patent: Nov. 30, 2004

(54) PRINTER SYSTEM FOR VERTICAL OR HORIZONTAL MOUNTING

(76) Inventor: William R. Sides, II, P.O. Box 432, Hana, HI (US) 96713

( * ) Notice: Subject to any disclaimer, the term of this patent is extended or adjusted under 35 U.S.C. 154(b) by 156 days.

(21) Appl. No.: 10/223,403

(22) Filed: Aug. 19, 2002

(65) Prior Publication Data

US 2004/0032481 A1 Feb. 19, 2004

(51) Int. Cl.[7] ..... B65H 5/22

(52) U.S. Cl. ..... 271/3.14; 271/162; 271/213; 347/104; 400/624

(58) Field of Search ..... 347/104, 153, 347/215, 262, 264; 271/3.14, 162, 207, 213; 400/624, 625

(56) References Cited

U.S. PATENT DOCUMENTS 5,454,555 A 10/1995 Kiyohara et al.
5,913,628 A 6/1999 Sides
5,924,808 A 7/1999 Sides
6,409,166 B1 * 6/2002 Kashimura ..... 271/213
6,714,326 B1 * 3/2004 Yamada ..... 358/498

* cited by examiner

*Primary Examiner*—David H. Bollinger
(74) *Attorney, Agent, or Firm*—Caesar, Rivise, Bernstein, Cohen & Pokotilow, Ltd.

(57) ABSTRACT

A printer, copier, facsimile machine or any other device for printing indicia on sheets of paper or other printable sheet materials. The device includes a paper input tray which is arranged to be oriented in a generally vertical direction irrespective of whether the device is in a horizontal orientation or a vertical orientation. The device also includes an output tray arranged to receive the paper or other printed sheet material exiting from the printer.

19 Claims, 12 Drawing Sheets

PRINTER SYSTEM FOR VERTICAL OR HORIZONTAL MOUNTING

BACKGROUND OF THE INVENTION

This invention relates to devices for printing indicia on sheets of paper or other printable media, and more particularly, to printing devices which may be disposed either horizontally or vertically.

With the advent of computers offices, homes and other institutions now commonly make use of devices or equipment for printing indicia on sheets of paper or other printable media. Examples of such devices are: printers, facsimile machines, copiers, etc. Heretofore such equipment has been limited in the manner in which it is disposed, e.g., it is either arranged to be disposed horizontally, such as on a desk, table, shelf, etc., or vertically, e.g., mounted on a wall.

U.S. Pat. No. 5,454,555 (Kiyohara) discloses a printer having a sheet feeding cassette and a sheet feed tray for providing paper to the printer. The printer may be used in a vertical or horizontal orientation but, as seen in FIGS. 1 and 3, is limited to being disposed on a horizontal surface.

While the Kiyohara patent may be generally suitable for its purposes. It still leaves much to be desired from various standpoints.

A need exists for a printer having a base arranged to be disposed horizontally or vertically on a horizontally or vertically oriented support surface, and with the printer having a reorientable paper input tray arranged to be mounted in either of two orientations with respect to the printer so that it can always be disposed generally vertically irrespective of the horizontal or vertical orientation of the printer, whereupon a printed page can drop out of the printer for collection and/or collation.

SUMMARY OF THE INVENTION

These and other objects of the invention are accomplished by providing a device, e.g., a printer, for producing an image on a sheet of paper or other printable material. The device having a base arranged to be mounted so that said base is disposed horizontally or vertically on a horizontally or vertically oriented support surface. The device has a reorientable sheet input tray and an outlet. The sheet input tray is arranged to be mounted in any of at least two orientations with respect to the device so that the input tray can always be disposed in a generally vertical direction irrespective of the horizontal or vertical orientation of the device. The sheet input tray is arranged to receive at least one sheet of paper or other printable sheet material and is coupled to the device so that at least one sheet of paper or other printable sheet material enters into the device.

DESCRIPTION OF THE DRAWINGS

Other objects and many of the attendant advantages of this invention will become readily appreciated as the same becomes better understood by reference to the following detailed description, when considered in connection with the accompanying drawings, wherein.

DETAILED DESCRIPTION OF THE PREFERRED EMBODIMENT

Figure 1:
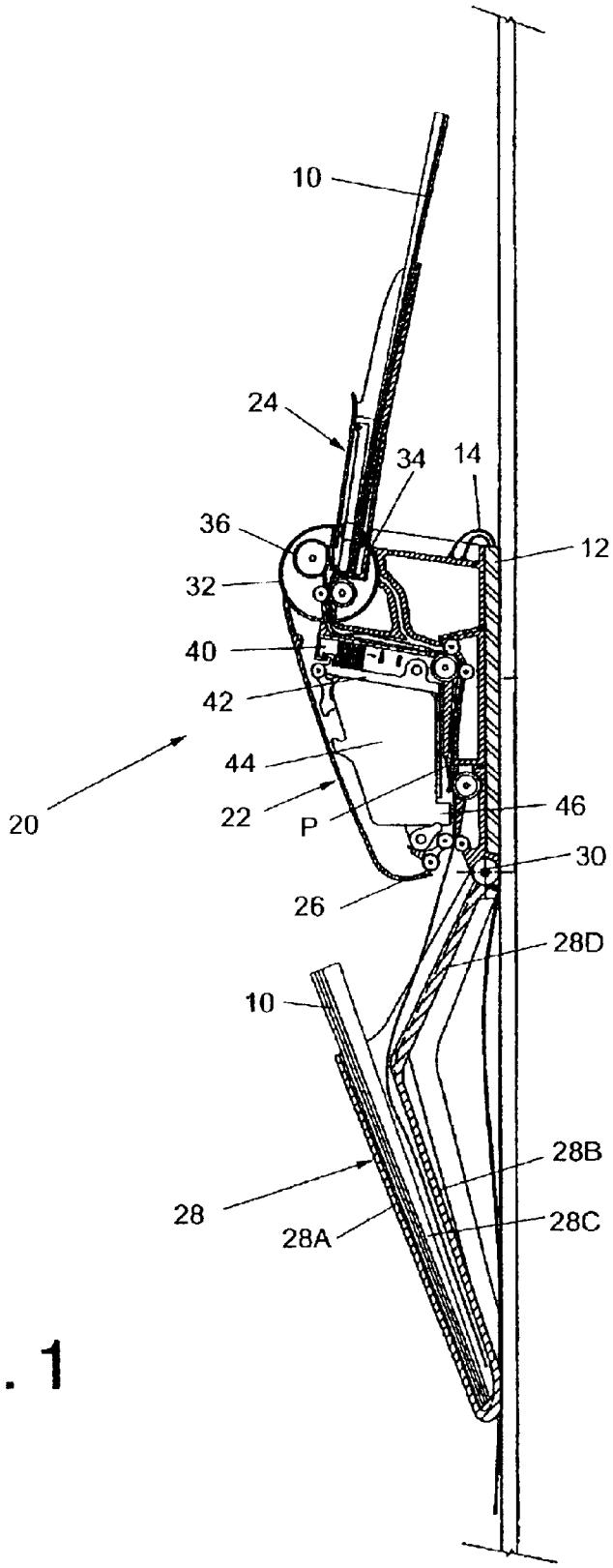
FIG. 1 is a side view, in full section, showing one embodiment of a device constructed in accordance with this invention mounted on a vertical wall and showing its input tray in a "top feed orientation;"

Referring now to the drawing wherein like reference characters refer to like parts, there is shown at 20 in FIG. 1 a printer or other device for printing indicia on sheet of paper 10 or other printable sheet material, e.g., transparency film, etc. In the embodiment shown herein the device 20 is a conventional ink jet printer, but that device is merely exemplary of the various devices with which the subject invention may be used.

Figure 2:
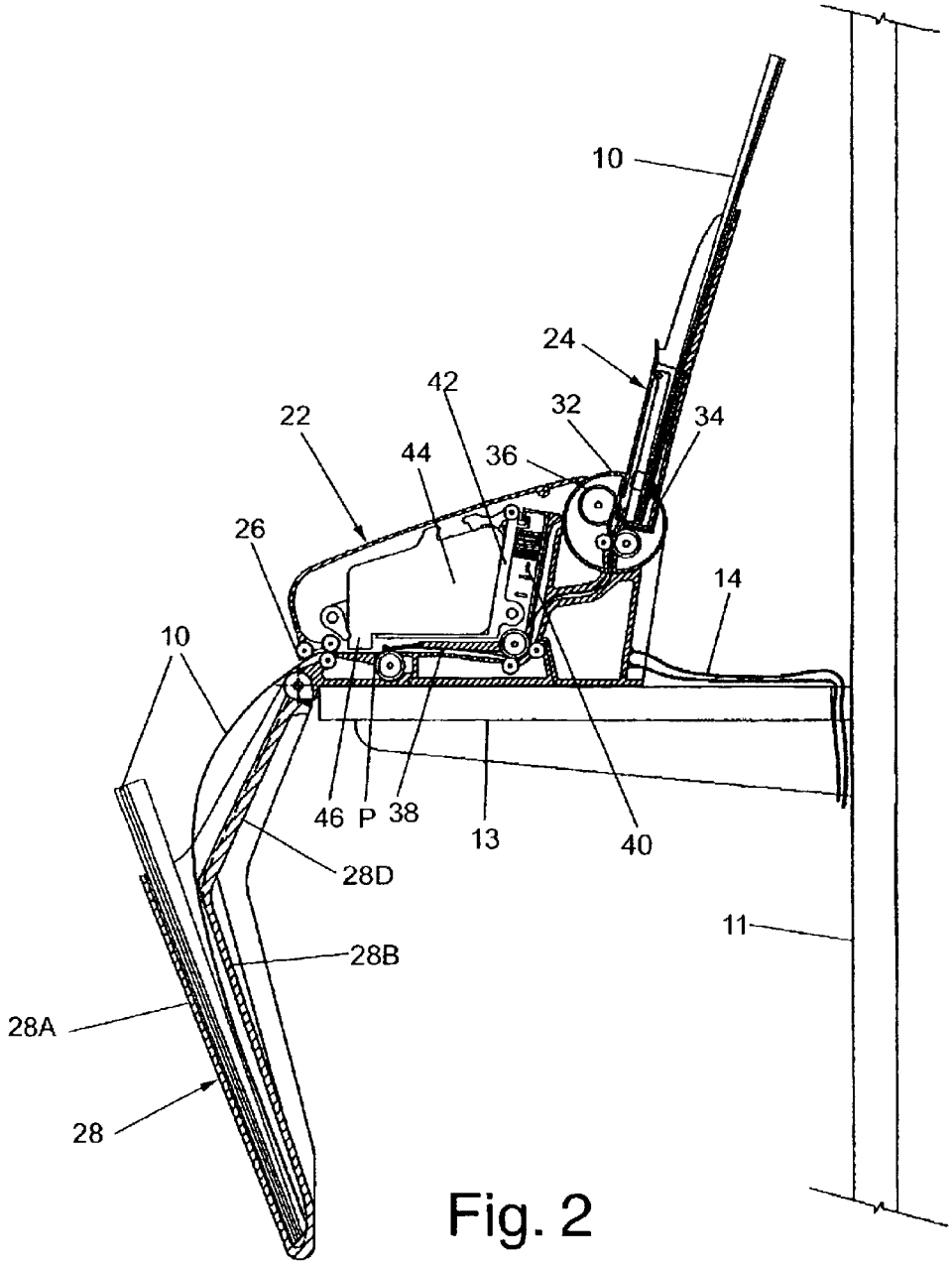
FIG. 2 is a side view, in full section, like that of FIG. 1, but showing the same embodiment of FIG. 1 mounted or disposed on a horizontal shelf.
Figure 3B:
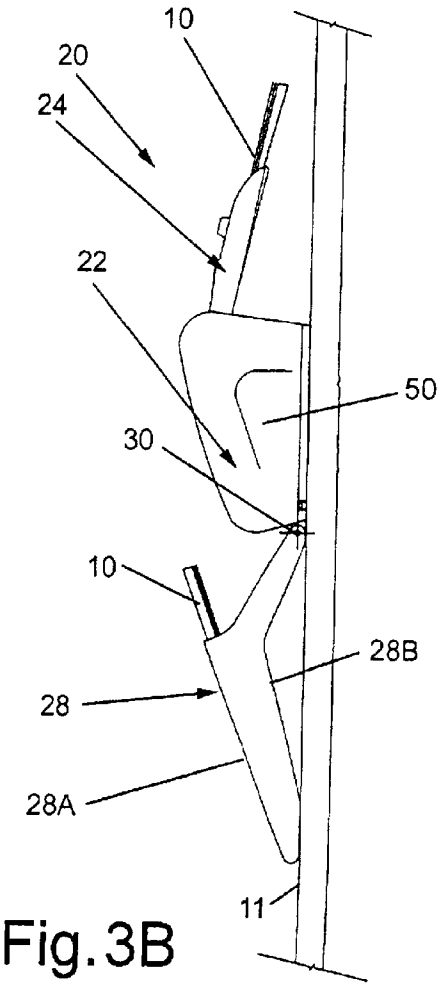
FIG. 3B is a side view of the device shown in FIGS. 1 & 3A.
Figure 3A:
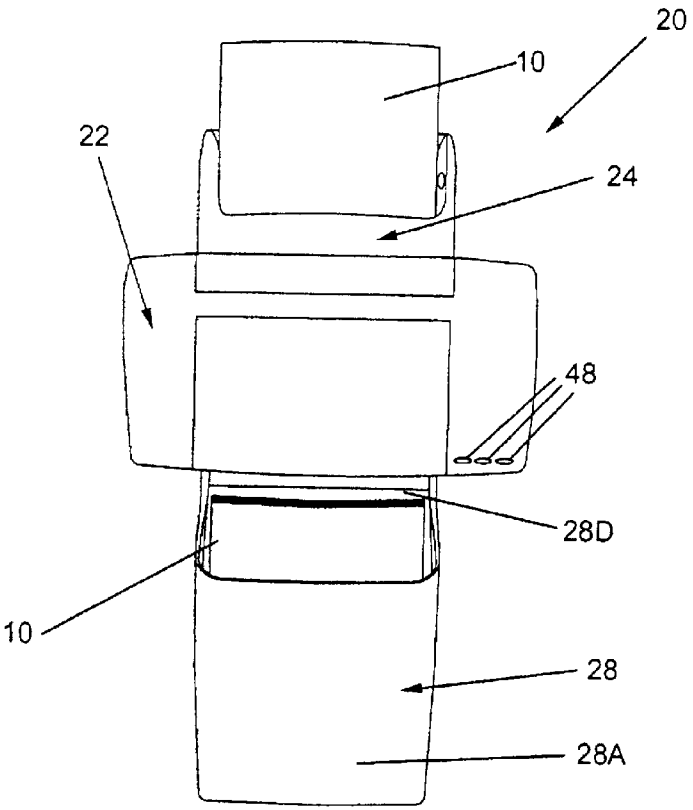
FIG. 3A is a front view of the device shown in FIG. 1 after the device has printed plural sheets of paper and such plural sheets are collected and collated by the outlet tray.
Figure 4B:
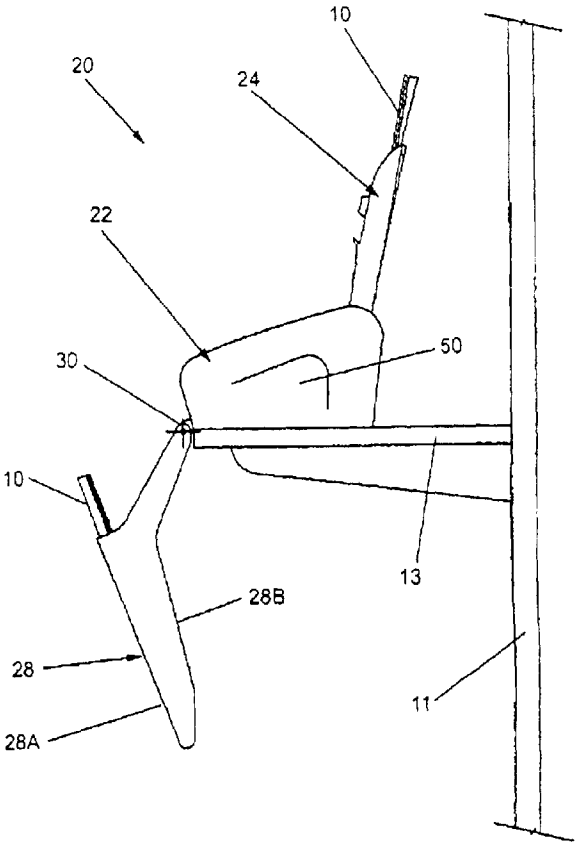
FIG. 4B is a side view of the device of FIGS. 2 & 4A.
Figure 4A:
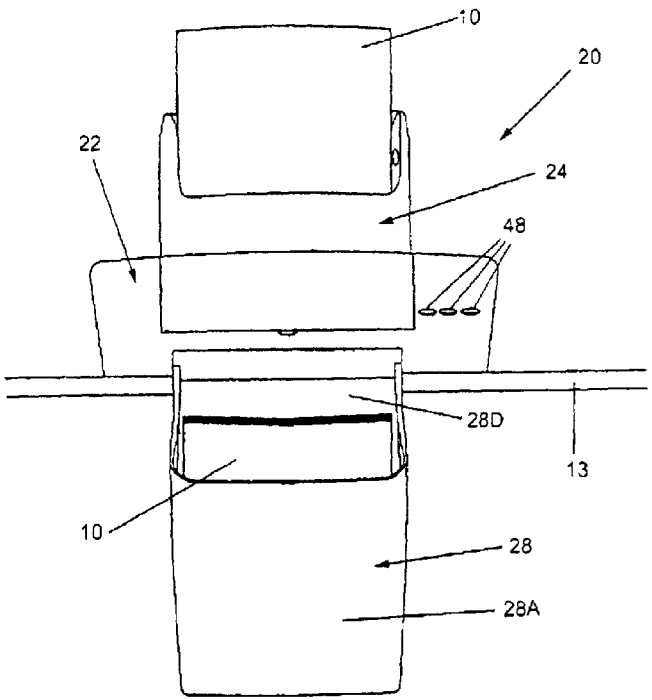
FIG. 4A is a front view of the device, mounted or disposed on a shelf, as shown in FIG. 2 after the device has printed plural sheets of paper and such plural sheets are collected and collated by the outlet tray.

The device 20 is arranged to be mounted vertically on a wall 11 via a mounting plate 12, like shown in FIGS. 1, 3A and 3B, or mounted or disposed horizontally on a shelf or bracket 13, like shown in FIGS. 2, 4A and 4B. It should be borne in mind that the device 20 can be located on any vertical surface, not only the wall 11 shown, e.g., on a vertical cubical partition surface. Similarly, the device can be located or disposed on any horizontal surface, such as a desk, table, etc., instead of a shelf or bracket 13. In any case the printer device includes a body or housing 22 in which its various operating components, e.g., paper transport mechanism, print heads, etc., are located. The printer 20 includes a multi-directional paper or sheet input tray 24. The tray 24 is constructed to hold a stack of plural paper sheets 10 or other printable sheet material, and to enable such sheets to feed to the printer from the top of the stack/tray (i.e., a "top feed" tray) or can be constructed to feed from the bottom of the stack/tray (i.e., a "bottom feed" tray). The bottom of the tray being defined as "that part of the tray which supports the paper." The input tray is arranged to be used with cam-type pick up roller printers (to be described later). Irrespective of the type of the input tray 24, the printer 20 itself is configurable to enable it be disposed in one of two orientations so that when the device 20 is located on the wall or on some other vertically oriented surface its input tray 24 is in a generally vertical direction and when the device 20 is located on the shelf or on some other horizontally oriented surface its input tray 24 is also in the generally vertical direction. It should be noted that the paper input tray 24 can be oriented so that it is in a precise vertical orientation, or it may be directed in a generally vertical orientation, e.g., at some acute angle with respect to horizontal, like shown in the drawings herein. Moreover, that acute angle can be relatively large, e.g., 45 degrees or more, to enable each sheet of paper 10 or other printable material to make use of gravity to effect or facilitate the entry of the each sheet of paper or other printable material into the device 20. Thus, the term "generally vertical direction" as used hereinafter should be understood to have a broad meaning. It should be noted that if the tray is in a precisely vertical orientation it would need some modification to keep the paper in it from falling forward. In the embodiment of the printer shown the input tray is limited to two positions. By widening the space that the paper enters the printer from the rotary device, one can readily provide a printer enabling one to adjust the tray somewhat (e.g., 5 degrees) at those positions.

The printer 20 also includes a dual directional outlet or exit port 26 located at a lower point on the housing and through which paper or other printable sheet material that have been printed with indicia by the print head of the printer exit for collection. In order to collect the printed sheets 10 exiting from the printer's outlet 26, the device includes an outfeed or outlet tray 28. The outlet or outfeed tray 28 is in the form of a basket hingedly mounted adjacent the outlet 26 so that it is oriented in a generally vertical direction, e.g., either precisely vertical or at some acute angle to vertical. The basket may be constructed in accordance with the teachings of my prior U.S. Pat. No. 5,924,808, wherein the basket section is collapsible, or may be of a fixed shape and configuration, e.g., molded, of plastic such as that of my prior U.S. Pat. No. 5,913,628, both of whose disclosures are incorporated by reference herein. Preferably, the tray/basket 28 is constructed like the embodiment shown in FIGS. 1, 2 and 5 herein. That tray/basket is a preformed unit that is hingedly connected to the device 20 so that it is suspended from the device and hangs in a generally vertical direction irrespective of whether the device is mounted vertically or horizontally. Moreover, the basket/tray 28 is constructed so that its front wall 28A extends at an acute angle to vertical.

Figure 5A:
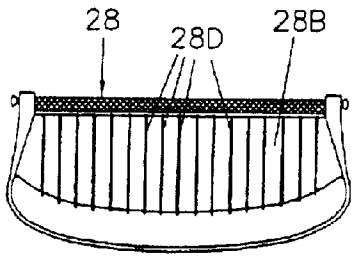
FIG. 5A is a top view taken along line 5A—5A of FIG. 5.
Figure 5B:
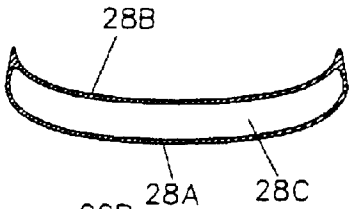
FIG. 5B is a sectional view taken along line 5B—5B of FIG. 5.
Figure 5C:
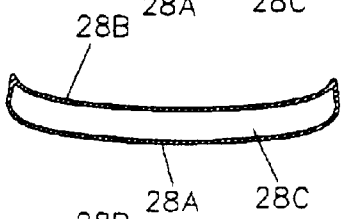
FIG. 5C is a sectional view taken along line 5C—5C of FIG. 5.
Figure 5D:
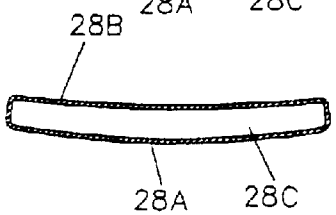
FIG. 5D is a sectional view taken along line 5D—5D of FIG. 5.
Figure 5:
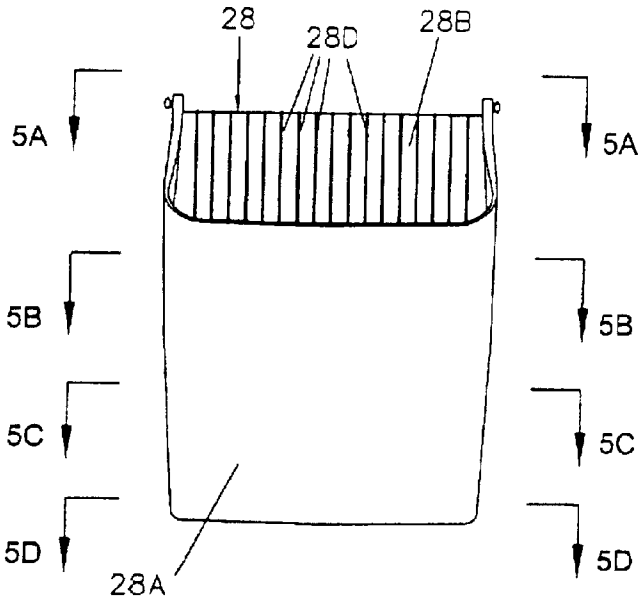
FIG. 5 is a front view of the paper collecting portion, or outlet tray of the device shown in FIGS. 1 & 2.

As best seen in FIGS. 1,2 and 5, the outfeed basket/tray 28 has the heretofore identified front wall 28A and a rear wall 28B. The entire front wall 28A and the lower portion of the rear wall 28B are each arcuate and merge together along the sides of the basket to form a wedge shaped interior 28C. The basket/tray is arranged so that the first sheet of paper 10 expelled from the device 20 drops directly into the hollow interior 28C of the basket/tray and rests against its front wall 28A and the next successive sheet drops into the hollow interior and rests against the first sheet. Successive sheets drop into the basket section in a similar manner to form a collated stack of sheets of paper. The curvature of the walls of the basket/tray are quite effective to flip both standard and legal size paper forward toward the front wall 28A in the interior 28C so that successive sheets can drop behind it in sequence. The upper portion of the rear wall 28B of basket/tray is generally planar and may include plural raised elongated ridges 28D extending parallel to each other from the top edge of the tray to the hollow interior to help directionally control the paper as it passes over the flat surface portion of the rear wall. The upper edge of the rear wall of the basket/tray includes a hinge assembly 30 for hingedly mounting the basket/tray 28 onto the printer 20 adjacent the outlet 26. The hinge assembly includes components (to be described later) that serve to protect the basket/tray in case it is impacted.

As will be appreciated by those skilled in the art when the printer 20 is in its vertical orientation, like shown in FIGS. 1, 3A and 3B, the paper outfeed basket/tray 28 will be oriented with respect to the printer so that it extends somewhat parallel to the bottom surface of the printer (i.e., the surface secured to the wall by the base mounting plate 12). When the printer 20 is in its horizontal orientation, like shown in FIGS. 2, 4A and 4B the paper outfeed basket/tray 28 will be oriented with respect to the printer so that it extends somewhat perpendicular to the bottom surface of the printer. In order to ensure that paper is fed expeditiously to the outfeed basket/tray 28 for collection and collation, the outlet 26 of the printer is dual directional. The details of the dual directional outlet will be described later.

In order to mount the printer 20 on the wall 11 the base plate is first attached to the wall, with electrical feed wires 13 for the printer running behind the plate. The printer 20 can then be hooked at the top of the plate 12 and swung down onto the plate and clipped in place. The wires 14 can then be plugged into the printer. The outfeed tray is then hooked onto the printer. The input tray 24 is then attached to the printer and set to the wall mounted orientation.

In the embodiment of FIGS. 1, 3A, 3B, 2, 4A and 4B the printer 20 includes a directional rotary mechanism 32 to which the input tray 24 is releasably secured. To that end as can be seen therein the mechanism 32 basically comprises a cylindrical member having a pocket or notch 34 arranged to releasably receive the input tray 24. In the embodiment shown in FIGS. 1 and 2 the printer is designed for a "top feed" input tray 24, i.e., the top-most sheet of paper 10 in the tray enters into the printer first. As is conventional, the printer 20 includes various drive and idler rollers for drawing and carrying the sheet of paper into and through the interior of the printer's housing 22 for engagement by the print heads to print indicia on the sheet. The path that the paper takes through the printer is defined by these rollers and associated conventional components and is generally designated by the letter "P." In particular, the paper path includes a "cam type" pick up roller 36, a paper guide 38, a carriage tracking assembly 40, a carriage assembly 42, and one or more ink cartridges 44 and associated printer heads 46. The paper guide 38 serves to flatten and guide the paper 10 under the printer head. The carriage assembly 42 holds the ink cartridges and tracks along two rods 43 and 45 (FIG. 1) of the tracking assembly 40, while the printer head(s) 46 shoot(s) the ink onto the paper 10 as the feed roller moves the paper under the print head(s). When the paper or other sheet of printable material reaches the print head it is flat and ready to receive the ink or other indica forming media. The ink or other indicia forming media is applied to the sheet and then the printed sheet is ejected via the outlet 26.

In the embodiment of the paper input tray 24 of FIGS. 1 and 2 the tray has a spring loaded bottom plate that is retained when loading, and then is released. The paper stack is pushed towards the printer's pick up wheel. The paper stack is held at the corners by two small clips (not show) just before contact with the wheel. When the printer calls for a sheet of paper, the cam wheel rotates around just once and pulls the top sheet free of the corner clips and into another moving drive roller. This drive roller takes over and feeds the paper further into the paper transport path P so that it can be printed and will exit outlet 26 for collection in the basket/tray 28. The paper input tray is curved at its top or free end (the portion directed away from the printer), but flattens out as it reaches the printer. This arrangement keeps legal size paper from flopping over so that each sheet feeds into the printer flat.

As should be appreciated by those skilled in the art in modern printers and other devices for applying indicia to sheets of paper or other printable material electronics and sensors control much of the gearing, roller functions and paper flow. These components are not shown in these drawings in the interest of drawing simplicity. The drive rollers or wheels are used to transfer the paper from the pick up roller or wheel to the feed roller. Because of the distance from the paper tray to the feed roller the printer 20 may include one or more additional rollers to enable the printer to accommodate short sheets of paper. The feed roller is coordinated with the printing functions and moves the paper past the printer head in sequence with the print cartridge/print head and ejects the paper from the outlet after completion of the printing process.

When the device 20 is to be wall or vertically mounted, the directional rotary mechanism is rotated to the state wherein the notch 34 is as shown in FIGS. 1, 3A and 3B, i.e., directed backward and downward toward the bottom surface of device 20. Thus, when the device is mounted on the wall (vertically) and the paper input tray inserted into the notch, the paper input tray 24 is directed upward and towards the wall. In this orientation the paper is picked up in sequence from the top of the stack. When the device 20 is to be shelf or horizontally mounted or disposed, the directional rotary mechanism is rotated to the state wherein the notch 34 is, as shown in FIG. 2, i.e., directed backward and upward (away from) the bottom surface of the device 20. Thus, when the device is mounted on the shelf (horizontally) and the paper input tray inserted into the notch, the paper input tray 24 is also directed upward and towards the wall (Just like in the orientation of FIG. 1). In this orientation the paper is also picked up in sequence from the top of the stack.

As mentioned earlier the outlet 26 is a dual directional outlet. In particular, it enables one to control the direction that the printed sheet leaves the device 20. Such action enables the outfeed basket/tray 28 to function better by controlling the direction that the paper enters it. In particular, as best seen in FIG. 1 a set of idler wheels and rollers are located just past the printer head and are in a fixed offset position. These wheels and rollers serve two purposes. First, by being offset they hold the paper sheet flat under the printer head. Second, when the device is wall or vertically mounted, they direct the paper towards the outfeed basket/tray. The wheels on the printed side of the paper includes little fingers that project outward to keep the rollers from smearing the ink before it has time to dry. The dual direction outlet also includes a third idler roller that is automatically moved into position when the printer is in the orientation shown in FIG. 2 to direct the exiting printed paper toward the output basket/tray. This third roller also includes wheels with little fingers that project outward to keep the roller from smearing the ink before it has time to dry.

As best seen in FIGS. 3A and 4A, the printer 20 includes plural control buttons 48 that are located adjacent the bottom right corner of the printer housing 22. The top of the printer housing is tilted for easy access from a sitting position. The opposed sides of the printer housing are indented at 50 (FIGS. 3B and 4B) to provide gripping surfaces to enable one to securely hold the printer while installing, removing or transporting it.

Figure 6:
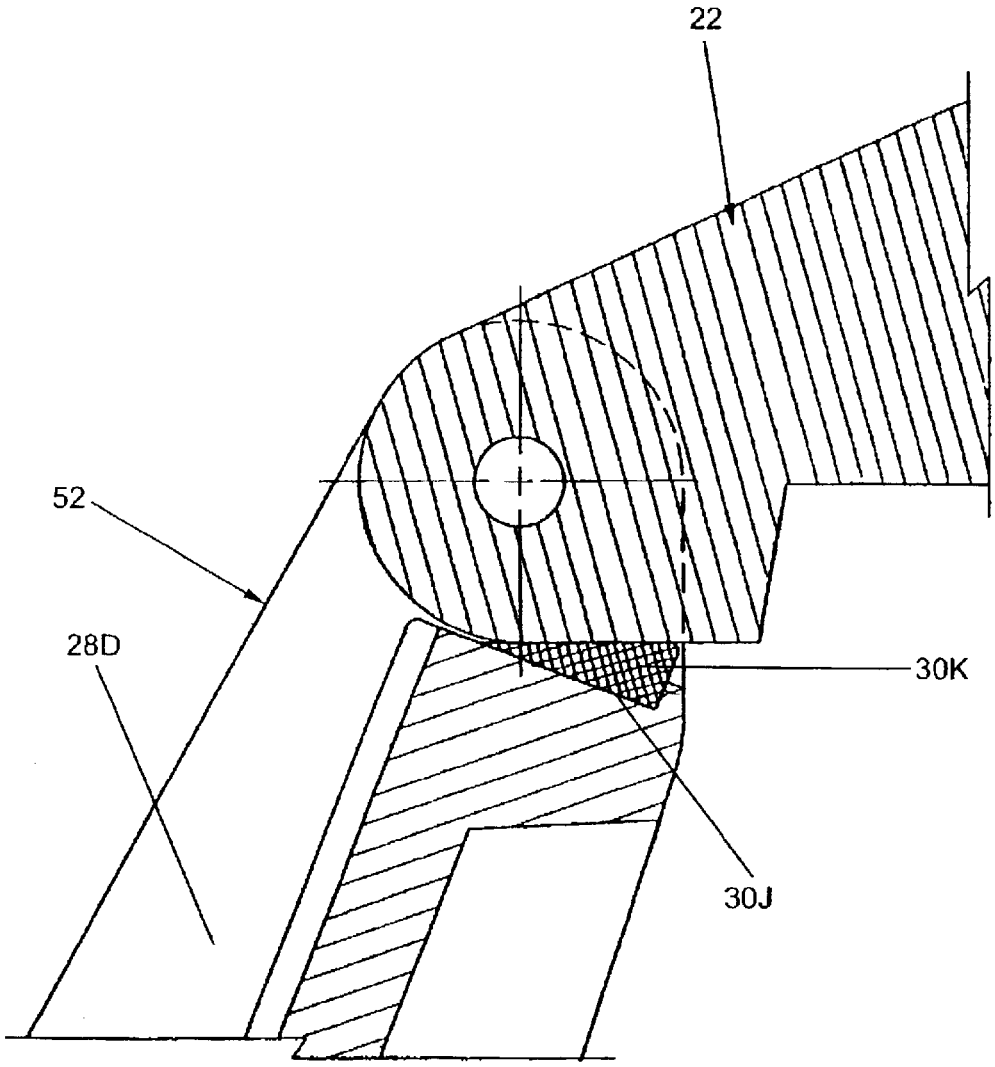
FIG. 6 is a greatly enlarged sectional view of a portion of the device shown in FIG. 1.
Figure 7:
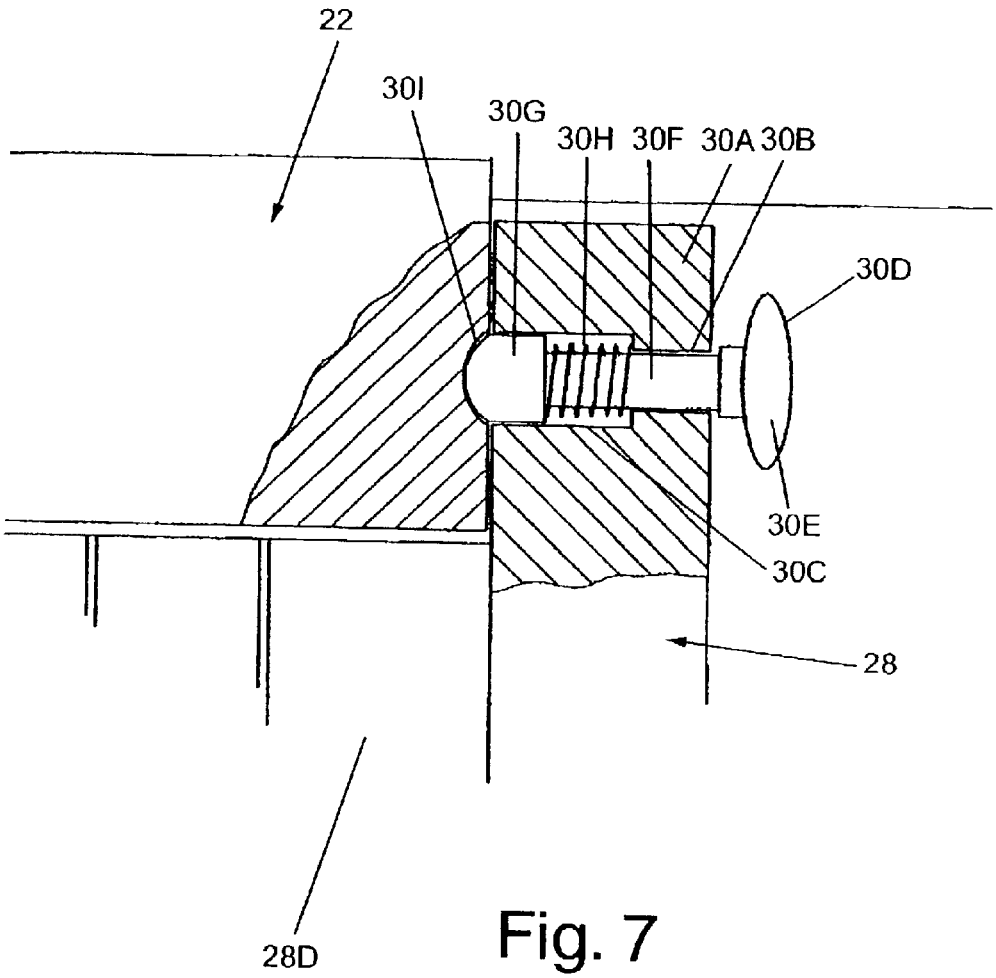
FIG. 7 is a greatly enlarged sectional view of another portion of the device shown in FIG. 1.

As mentioned earlier the printer 20 includes a hinge assembly 30 including components for preventing damage to the outfeed tray in the event that it is impacted. Those components will be now be discussed. In particular, as can be seen in FIG. 7 the hinge assembly 30 includes a pair of ears 30A, only one of which is shown, projecting outward from the top of the rear wall of the outfeed tray 28 on opposite sides thereof. Each of the ears includes a bore extending therethrough. The bore includes an outside portion 30B whose diameter is smaller than an inside portion 30C. A break away mounting pin 30D extends through the bore and includes a head 30E and an intermediate shaft 30F. The inner end of the shaft 30F is in the form of an enlarged domed plug 30G. A compression spring 30H extends about the shaft and is interposed between the wall of the ear at the outside end of the bore portion 30C and the domed plug 30G to bias the plug inward. The domed end of the plug 30G is arranged to be received within a corresponding shaped recess 301 in a portion of the housing contiguous with the dual direction outlet 26. The spring 30H provides a bias force to hold the plug within its associated recess. The other side of the outlet tray and the printer are similarly constructed. Accordingly, when the mounting pins' domed plugs are located within the respective recesses 301, the longitudinal axis extending through those aligned members form the pivot or hinge axis for the paper outfeed tray 28. As best seen in FIG. 6 recess 30J is provided in the rear wall 28D of the outfeed tray adjacent the paper outlet of the housing 22, and a resilient, e.g., rubber, cushion wedge 30K is located within the recess. Thus, if the outfeed tray 28 is impacted by a force or pushed in the direction of the arrow 52, the wedge will absorb the shock and serve to return the tray to its normal position. In the event that the force or push is too great for the cushion wedge 30K to accept, the domed plugs 30G of the break-away pins will automatically exit their associated recesses, against the bias force provided by their associated springs, thereby disconnecting the outfeed tray from the printer.

All other embodiment disclosed herein preferably include the breakaway/cushioned hinge assembly of the printer 20.

Figure 8:
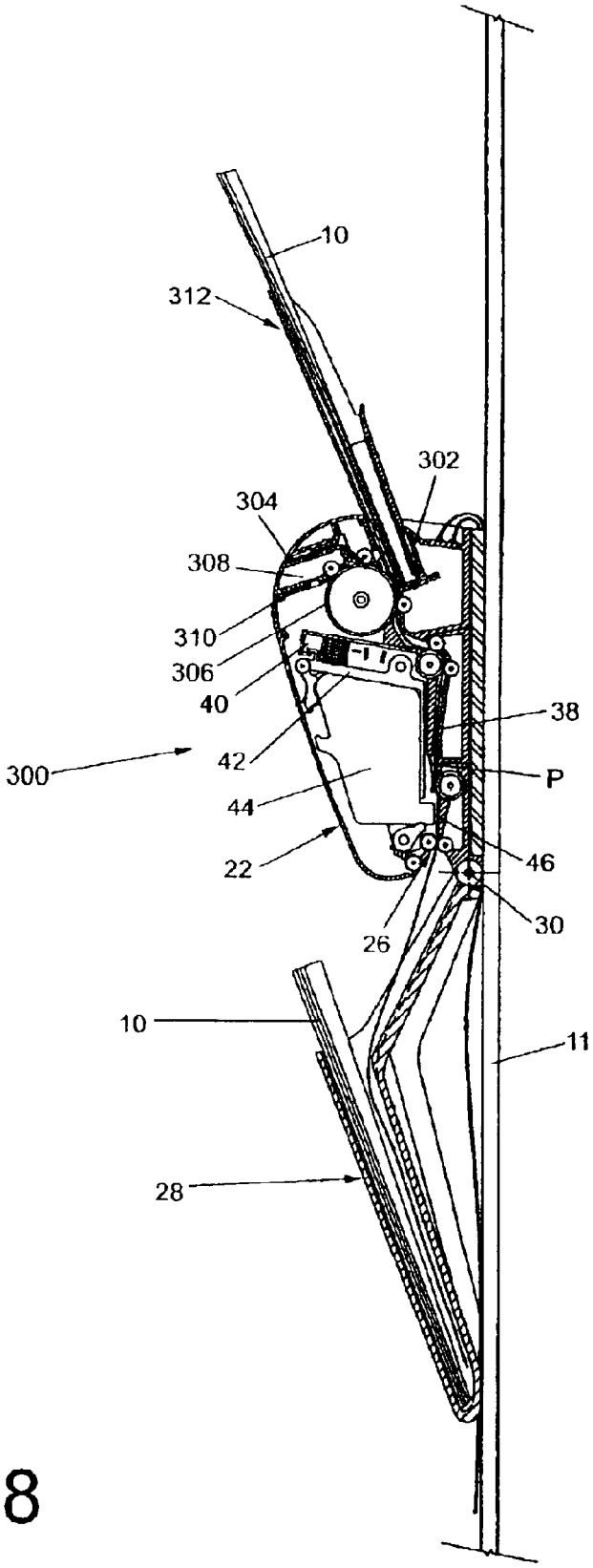
FIG. 8 is a side view, in full section, similar to FIG. 1, but showing another embodiment of a device constructed in accordance with this invention in its wall-mounted (vertical) orientation with its input tray in a "bottom feed orientation;"
Figure 9:
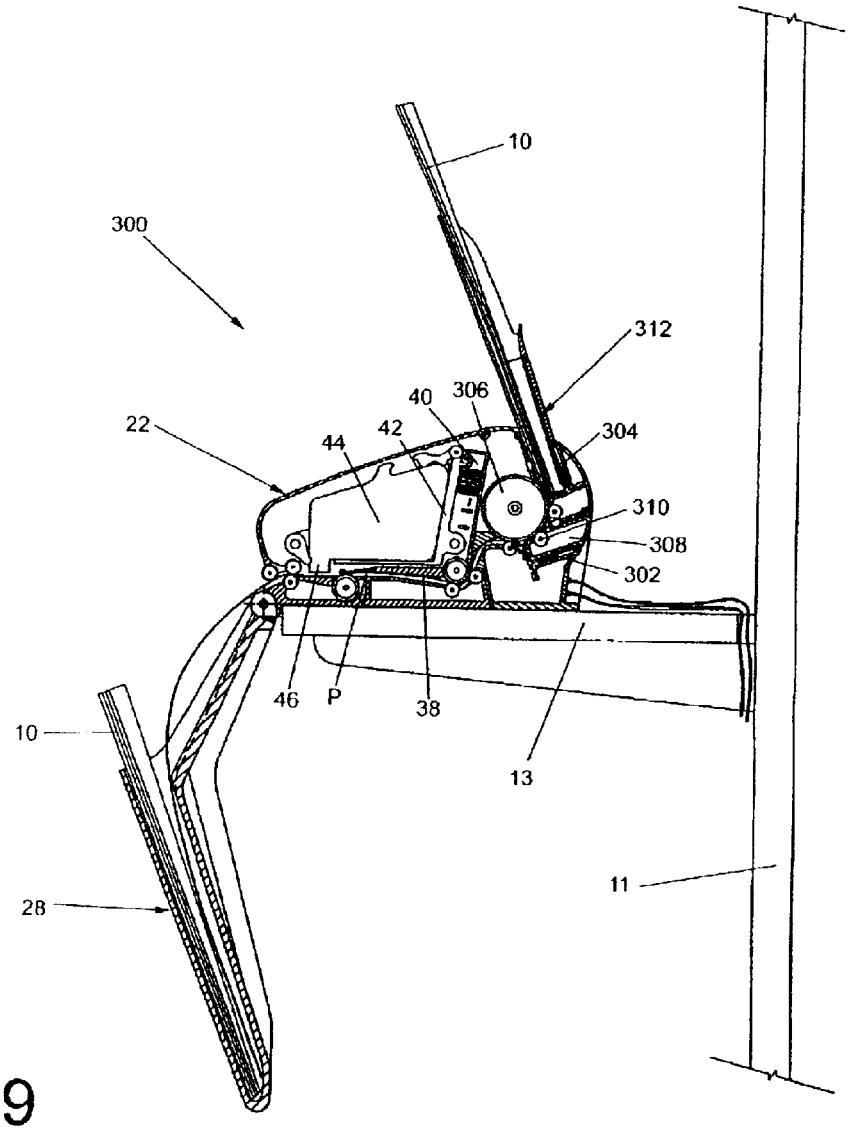
FIG. 9 is a side view, in full section, like that of FIG. 8, but showing that embodiment in its shelf-mounted (horizontal) orientation.
Figure 10B:
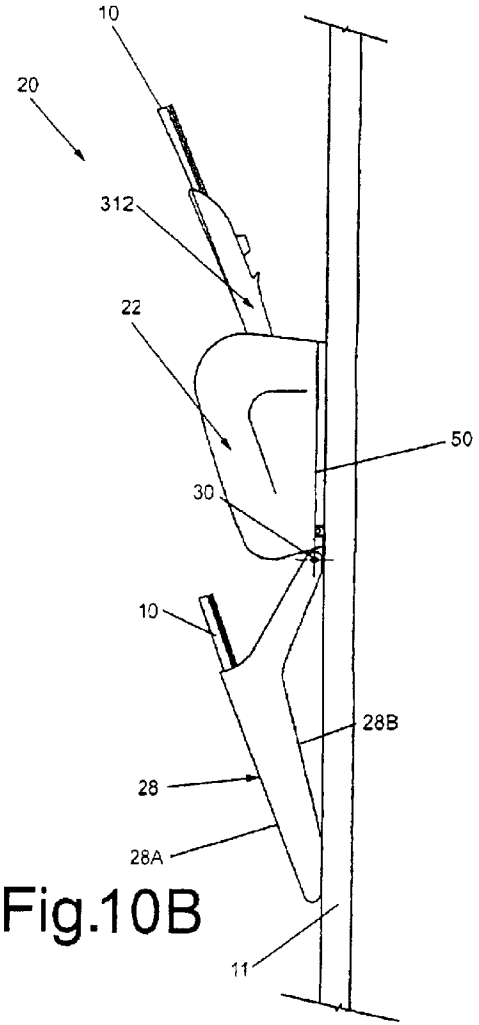
FIG. 10B is a side view of the device shown in FIGS. 8 & 10A after the device has printed plural sheets of paper and such plural sheets are collected and collated by the outlet tray.
Figure 10A:
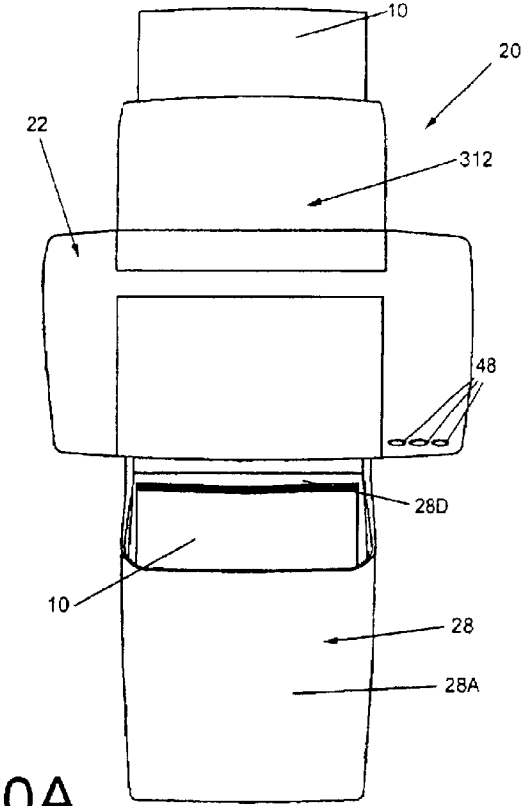
FIG. 10A is a front view of the device shown in FIG. 8 after the device has printed plural sheets of paper and such plural sheets are collected and collated by the outlet tray.
Figure 11B:
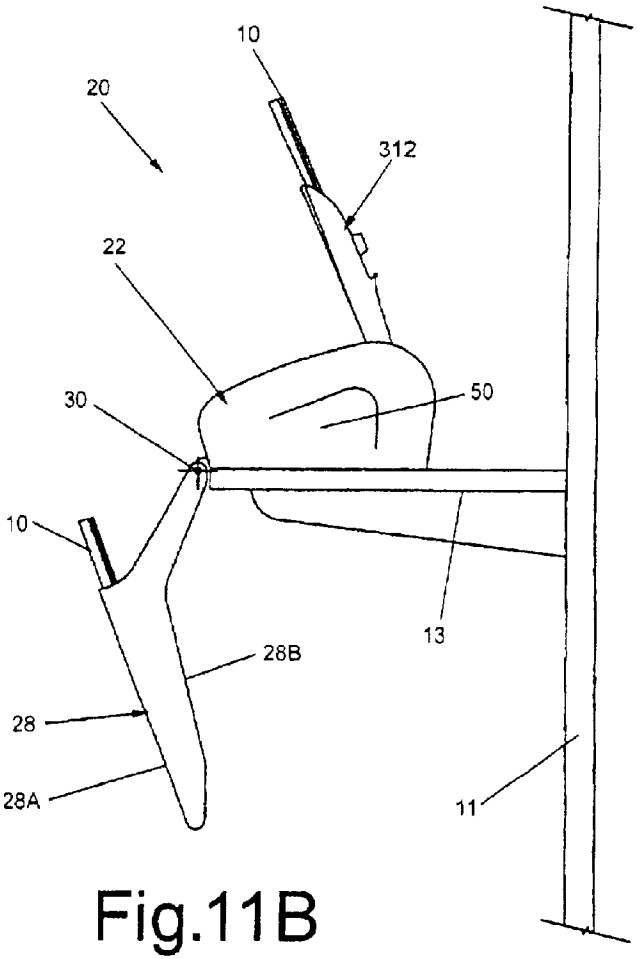
FIG. 11B is a side view of the device shown in FIGS. 9 & 11A.
Figure 11A:
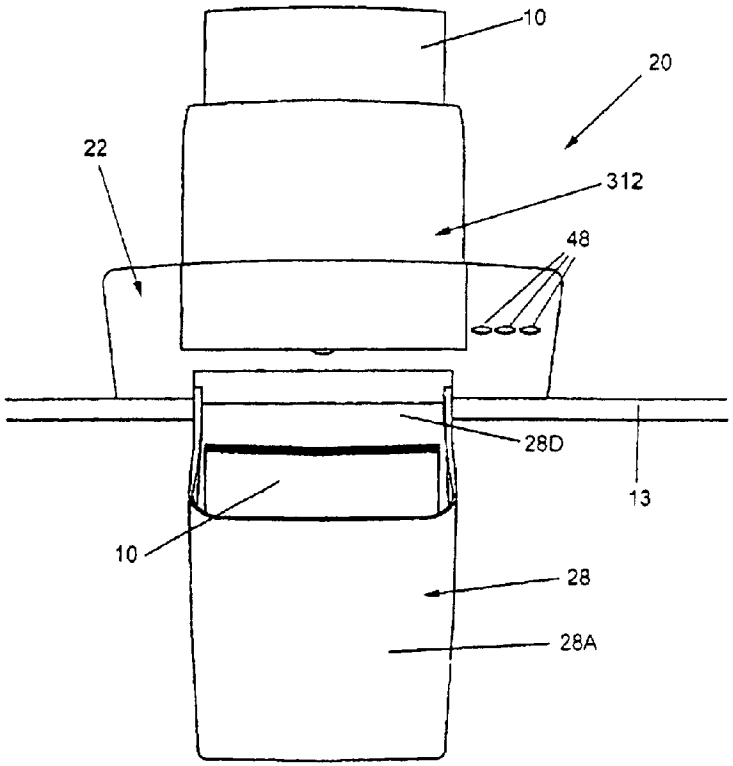
FIG. 11A is a front view of the device, shelf-mounted (horizontal), shown in FIG. 9 after the device has printed plural sheets of paper and such plural sheets are collected and collated by the outlet tray.

Turning now to FIGS. 8 and 9, an alternative embodiment of a printer constructed in accordance with this invention will now be described. That embodiment is designated by the reference number 300 and is similar in most respects to the embodiment 20, except for the design of the paper input tray 312 and it's mounting. Thus, in the interest of brevity the components of the printer 300 that are the same as those of printer 20 will be given the same reference numbers and the details of their construction and operation will not be reiterated.

As can be seen the printer 300 includes a pair of slots 302 and 304. Each of the slots is arranged to releasably receive the paper input tray 312. The paper input tray 312 is different than that in the embodiment of FIGS. 1 and 2 in that it is "bottom feed" (the first paper to enter the printer comes off the bottom of the stack) and the tray is designed for a round pick up wheel system. The slot 302 is oriented so that it extends at an acute angle rearwardly and upwardly with respect to the bottom surface of the printer (the portion that is secured to the mounting plate 12). The slot 304 is oriented generally perpendicularly to the slot 302. A plug/paper transport member 308 is arranged to be releasably located in either of the slots 302 and 304, whichever slot is not being used by the paper input tray (as will be discussed later). The plug/paper transport member 308 is designed to cooperate with the round-type pick-up roller 306 in directing the paper. That roller is located within the printer's housing 22 to effect the carriage of a sheet of paper from the tray 312 into the printer 300 for printing by the print head(s) 46. For example, as shown in FIG. 8 when the paper input tray 312 is located within slot 302, the plug/paper transport member 308 is located within the slot 304. In this arrangement the paper input tray leans away from the wall, but is still in the generally vertical direction, while the printer itself is vertically oriented. The paper sheets in the tray are picked up in sequence starting at the bottom of the stack. The pick-up of the bottom sheet is effected by the pick-up roller 306. Once the sheet is picked up it is carried through the paper transport path by the various rollers and components making up that path. If desired the printer need not include the roller 310. It should be appreciated by those skilled in the art that in the embodiment of the printer 300 the paper tray and pickup design is somewhat more complex than that of the printer 20. In particular, it differs in that the paper moves into and out of contact with the round pick up roller, rather than the cam-shaped pick up roller rotating into contact with the paper. Thus, when the printer 300 calls for a piece of paper, the levers under the stack of paper push the stack into the pick up roller. The paper is pulled off the bottom into the roller system and the stack is immediately moved out of contact. The paper sheets that attempt to follow are stopped and returned to the stack by a kicker member. The pick-up roller then serves as a drive roller and moves the paper through the printer.

As will also be appreciated by those skilled in the art in the arrangement of FIG. 8 the paper 10 is less visible in the tray 312 and has to be loaded over the top of the taller portion of that tray.

In FIG. 9 the printer 300 is mounted on a shelf 13. In such an arrangement the paper input tray 312 is located within the slot 304, and the plug/paper transport member 308 is located within the slot 302. In this arrangement the paper input tray is oriented in the same direction as in FIG. 8, notwithstanding the fact that the printer 300 is oriented horizontally. Operation of the printer 300 in this orientation is the same as in the orientation of FIG. 8.

Figure 12A:
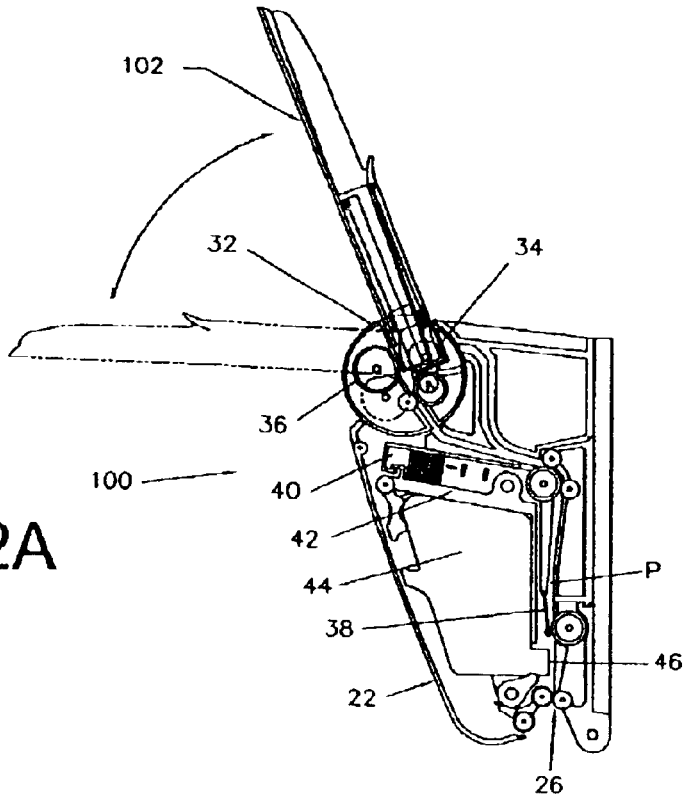
FIG. 12A is a reduced sectional view (outlet tray not shown) of yet another embodiment of a device constructed in accordance with this invention in it's wall mounted (vertical) orientation similar to FIGS. 1 & 2, but with a forward rotatable "bottom feed" input tray.
Figure 12B:
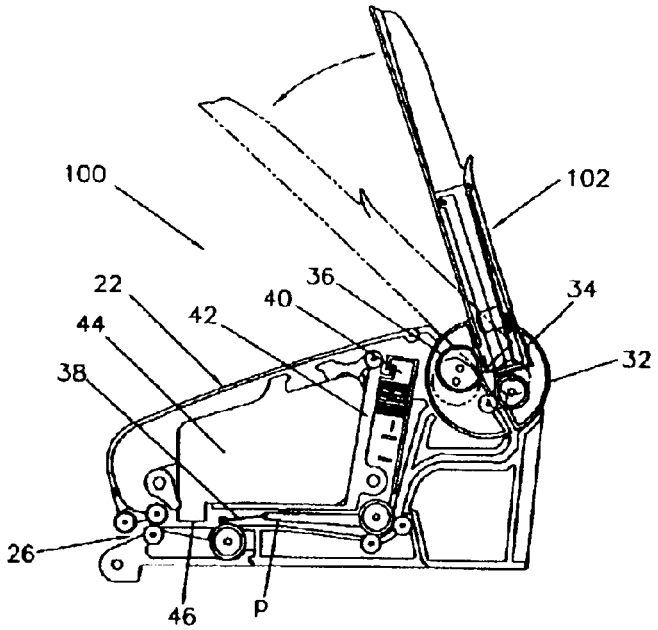
FIG. 12B is a sectional view like that of FIG. 12A, but showing that embodiment in its shelf-mounted (horizontal) orientation, and with its outlet tray not being shown.

Turning now to FIGS. 12A and 12B, another embodiment of a printer constructed in accordance with this invention will now be described. That embodiment is designated by reference number 100. 100 is shown with its input tray in a "bottom feed orientation," and with its outlet tray not being shown. In the interest of brevity the components of the printer 100 that are the same as those of printer 20 will be given the same reference numbers and the details of their construction and operation will not be reiterated. Moreover, the illustrations of FIGS. 12A and 12B are not crosshatched in the interest of drawing simplicity. In this embodiment the printer 100 has been designed for a "bottom feed" input tray. The input tray 102 is constructed similar to the tray for printer 20 (FIGS. 1 and 2) in that it uses the same mechanism to support a cam type pick up wheel but is oriented and designed such that the paper feeds from the bottom of the stack. The other feature is that the tray 102 with the rotary mechanism 32 can be rotated forward for loading the paper into the tray. In FIG. 12A, with the printer located in the wall-mounted (vertical) orientation, the input tray 102 can be pulled forward and down until it is in a horizontal orientation where the paper 10 can then be easily loaded into the tray. This action can also be used to retain the spring loaded bottom plate (see description for tray 24) of the tray until after the tray has been loaded. The input tray 102 can then be returned to its proper vertical operating orientation, whereupon the spring loaded bottom of the tray will be released to ready the paper 10 for feeding to the printer. In FIG. 12B with the printer located in it's shelf-mounted (horizontal) orientation the tray 102 can be loaded the same as stated above for FIG. 12A, but the tray will only be able to be pulled down to approximately 45 degrees and then returned to it's proper vertical operating orientation.

It should be apparent to those skilled in the art that the "printer" of this invention is not limited to any particular type of device for printing indicia on paper or some other printable sheet materials. So too, the particular input tray and/or output tray used is a matter of choice, providing that the printer and the input tray can be oriented so that when the printer is in a horizontal orientation the paper input tray is at a generally vertical direction, and when the printer is in a vertical orientation the paper input tray is also at a generally vertical direction. Moreover, the type of pick up mechanism for the sheets from the input tray is also a matter of choice. For example, the printer may use a round wheel pick up roller system, such as used by Hewlett-Packard Company, or may use a cam roller pick up system, such as used by other printer manufacturers. The input tray can either be a top feed or a bottom feed tray for use with either a round wheel pick up roller system or a cam roller pick up system. Moreover, the type of output tray or other collector used is a matter of choice. Thus, the output tray need not effect collation of the printed sheets. Further still, by removing the outfeed tray and attaching a mounting plate onto the printer's housing, one can use the printer as a conventional trayless printer for desktop use.

Without further elaboration, the foregoing will so fully illustrate my invention that others may, by applying current or future knowledge, readily adapt the same for use under various conditions of service.

I claim:

1. A device for producing an image on a sheet of paper or other printable material, said device having a base arranged to be mounted so that said base is disposed horizontally or vertically on a horizontally or vertically oriented support surface, said device having a reorientable sheet input tray and an outlet, said sheet input tray being arranged to be mounted in any of plural orientations with respect to said device so that said input tray can always be disposed in a generally vertical direction irrespective of the horizontal or vertical orientation of said device, said sheet input tray being arranged to receive at least one sheet of paper or other printable sheet material and being coupled to said device so that said at least one sheet of paper or other printable sheet material enters into said device.

2. The device of claim 1 wherein said sheet of paper or other printable sheet material is arranged to enter into said device from above said device.

3. The device of claim 2 wherein said device is arranged for printing indicia on said at least one sheet of paper or other printable sheet material so that on said at least one sheet of paper or other printable sheet material exits said outlet and drops below said device for collection.

4. The device of claim 1 wherein said at least one sheet of paper or other printable sheet material exits said device from said outlet, and wherein said device includes an output tray for receiving said at least one sheet of paper or other printable sheet material.

5. The device of claim 4 wherein said tray is in the form of a basket arranged to collate each sheet of paper or other printable sheet material which is received therein.

6. The device of claim 1 wherein said reorientable sheet input tray is mounted on a rotatable mechanism to position said input tray in a generally vertical direction irrespective of the horizontal or vertical orientation of said device.

7. The device of claim 1 wherein said sheet input tray is arranged to be releasably mounted on said rotatable mechanism.

8. The device of claim 1 wherein said sheet input tray comprises a top feed outlet arranged to have said at least one sheet of paper or other printable sheet material pass therethrough to enter into said device.

9. The device of claim 8 wherein said sheet input tray is arranged to be mounted on said device in so that said top feed outlet is coupled to said device to enable said at least one sheet of paper or other printable sheet material to pass therethrough into said device.

10. The device of claim 1 wherein said sheet input tray comprises a bottom feed outlet arranged to have said at least one sheet of paper or other printable sheet material pass therethrough to enter into said device.

11. The device of claim 10 wherein said sheet input tray is arranged to be mounted on said device in so that said bottom feed outlet is coupled to said device to enable said at least one sheet of paper or other printable sheet material to pass therethrough into said device.

12. The device of claim 1 wherein said device includes two tray receiving slots for releasably receiving said sheet input tray therein, one of said slots being oriented so that when said sheet input tray is located in said one of said slots and said device is disposed on a horizontal support surface said sheet input tray is in a generally vertical direction, the other of said slots being oriented so that when said sheet input tray is located in said other of said slots and said device is disposed on a vertical support surface said sheet input tray is in a generally vertical direction.

13. The device of claim 1 wherein said sheet input tray is a bottom feed tray and said device is arranged to be vertically mounted with said bottom feed input tray arranged to be rotated forward to a generally horizontal position.

14. The device of claim 1 wherein said sheet input tray is a bottom feed tray and said device is arranged to be horizontally mounted with said bottom feed input tray arranged to be rotated forward to a generally forty-five-degree angle.

15. The device of claim 4 wherein said output tray is pivotably mounted with respect to said device such that said output is disposed in a generally vertical direction irrespective of the horizontal or vertical orientation of said device.

16. The device of claim 15 additionally comprising a biased detent mechanism to hold said output tray at a desired orientation with respect to said device, said biased detent mechanism being arranged to be overcome in the event that said output tray is impacted.

17. The device of claim 15 additionally comprising a resilient material stop coupled between said device and said output tray.

18. The device of claim 1 wherein said outlet comprises a dual directional outlet.

19. The device of claim 1 additionally comprising a plate for mounting said device on a vertical surface.

* * * * *